US010534285B2

(12) United States Patent
Utsumi

(10) Patent No.: US 10,534,285 B2
(45) Date of Patent: Jan. 14, 2020

(54) INFORMATION PROCESSING APPARATUS FOR CORRECTING IMAGE DATA CORRESPONDING TO REFLECTING SURFACE, AND IMAGE FORMING APPARATUS

(71) Applicant: CANON KABUSHIKI KAISHA, Tokyo (JP)

(72) Inventor: Yuichi Utsumi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/215,379

(22) Filed: Dec. 10, 2018

(65) Prior Publication Data

US 2019/0187584 A1 Jun. 20, 2019

(30) Foreign Application Priority Data

Dec. 20, 2017 (JP) ..... 2017-244420

(51) Int. Cl.
*G03G 15/043* (2006.01)

(52) U.S. Cl.
CPC ..... *G03G 15/043* (2013.01)

(58) Field of Classification Search
CPC ..... G03G 15/043; G02B 26/127; B41J 2/471
See application file for complete search history.

(56) References Cited

U.S. PATENT DOCUMENTS

| | | | | |
|---|---|---|---|---|
| 9,575,314 | B2 | 2/2017 | Araki | G02B 26/124 |
| 2009/0169228 | A1* | 7/2009 | Yokoi | G03G 15/326 399/51 |
| 2013/0141510 | A1 | 6/2013 | Araki | G02B 26/124 |
| 2015/0346484 | A1* | 12/2015 | Suzuki | G02B 26/12 347/118 |
| 2017/0019560 | A1* | 1/2017 | Horiuchi | H04N 1/4052 |
| 2017/0019563 | A1* | 1/2017 | Araki | H04N 1/4052 |
| 2017/0329264 | A1* | 11/2017 | Haruna | G03G 15/2028 |

FOREIGN PATENT DOCUMENTS

| | | |
|---|---|---|
| JP | 2001-133708 | 5/2001 |
| JP | 2004-271691 | 9/2004 |
| JP | 2013-117699 | 6/2013 |

* cited by examiner

*Primary Examiner* — Sandra Brase
(74) *Attorney, Agent, or Firm* — Venable LLP

(57) ABSTRACT

An information processing apparatus includes: a second reception unit configured to receive a predetermined signal outputted via a first signal line from the image forming unit; a third reception unit configured to receive a surface information outputted via a second signal line from the image forming unit; a storage unit configured to store, in association with the surface information, a plurality of pieces of correction data respectively corresponding to a plurality of reflecting surfaces; a correction unit configured to correct the image data to correspond to a reflecting surface onto which a light for scanning a photosensitive member is to be deflected, based on correction data; and a third output unit configured to, in response to receiving the predetermined signal, output the corrected image data.

18 Claims, 9 Drawing Sheets

INFORMATION PROCESSING APPARATUS FOR CORRECTING IMAGE DATA CORRESPONDING TO REFLECTING SURFACE, AND IMAGE FORMING APPARATUS

BACKGROUND OF THE INVENTION

Field of the Invention

The present invention relates to an image forming apparatus using an electro-photographic method, and an information processing apparatus.

Description of the Related Art

An image forming apparatus using an electro-photographic method has a scanner unit for exposing a photosensitive member. In the scanner unit, light emitted based on an image signal is deflected by a polygon mirror that rotates. A latent image is formed on the photosensitive member by the deflected light scanning and exposing the photosensitive member.

The shape of surfaces of the polygon mirror that deflects laser light differs for each surface. When the surface shape differs for each surface, the latent image formed on an outer circumferential surface of a photosensitive drum distorts in accordance with the laser light deflected by each surface.

Accordingly, Japanese Patent Laid-Open No. 2004-271691 discloses using a Hall element to identify a reflecting surface used for scanning, performing a correction (correction of a scanning start position, or the like) in accordance with each reflecting surface on the image signal, and performing image forming based on the corrected image signal. In addition, US-2013-141510 discloses a configuration in which the reflecting surface being used for scanning is identified based on a main scanning synchronization signal, and the scaling ratio of an image is corrected in accordance with the identified reflecting surface. Processing for suppressing distortion caused by reflecting surfaces of the polygon mirror is performed in synchronization with the main scanning synchronization signal, in an image control unit which generates the image signal. In addition, an engine control unit for controlling a scanner unit and the image control unit transmit and receive various information by serial communication, as recited in Japanese Patent Laid-Open No. 2001-133708.

In a configuration where the engine control unit identifies the reflecting surface, the image control unit needs to receive from the engine control unit a notification of information relating to the reflecting surface, in order to suppress the distortion due to the reflecting surface of the polygon mirror. However, when a new communication line is provided between the engine control unit and the image control unit for the notification of surface information, this leads to a cost increase and an increase in size of the image forming apparatus.

SUMMARY OF THE INVENTION

According to an aspect of the present invention, an information processing apparatus connected with an image forming apparatus includes an image forming unit, and the image forming unit includes: a first reception unit configured to receive image data; a light source configured to output light based on the image data received by the first reception unit; a rotational polygonal mirror having a plurality of reflecting surfaces, and configured to, by rotating, deflect the light outputted from the light source to scan a photosensitive member by using the plurality of reflecting surfaces; a light-receiving unit configured to receive the light deflected by the rotational polygonal mirror; an identification unit configured to identify a reflecting surface used for scanning of the photosensitive member, out of the plurality of reflecting surfaces; a first output unit configured to use a first signal line to output a predetermined signal in accordance with the light-receiving unit receiving the light; a second output unit configured to use a second signal line different to the first signal line to output surface information indicating the reflecting surface identified by the identification unit, the surface information being outputted in response to the first output unit outputting the predetermined signal. The information processing apparatus includes: a second reception unit configured to receive the predetermined signal outputted via the first signal line from the first output unit; a third reception unit configured to receive the surface information outputted via the second signal line from the second output unit; a storage unit configured to store, in association with the surface information, a plurality of pieces of correction data respectively corresponding to a different one of the plurality of reflecting surfaces; a correction unit configured to correct the image data corresponding to a reflecting surface onto which the light for scanning the photosensitive member is to be deflected, based on correction data, which is stored in the storage unit, corresponding to the surface information received by the third reception unit; and a third output unit configured to, in response to the second reception unit receiving the predetermined signal outputted by the first output unit, output the corrected image data to the image forming unit.

Further features of the present invention will become apparent from the following description of exemplary embodiments with reference to the attached drawings.

DESCRIPTION OF THE EMBODIMENTS

Exemplary embodiments of the present invention will be described hereinafter, with reference to the drawings. Note, the following embodiments are examples and the present invention is not limited to the content of the embodiments. Also, for the following drawings, elements that are not necessary in the description of the embodiment are omitted from the drawings.

Image Forming Operation

Figure 1:
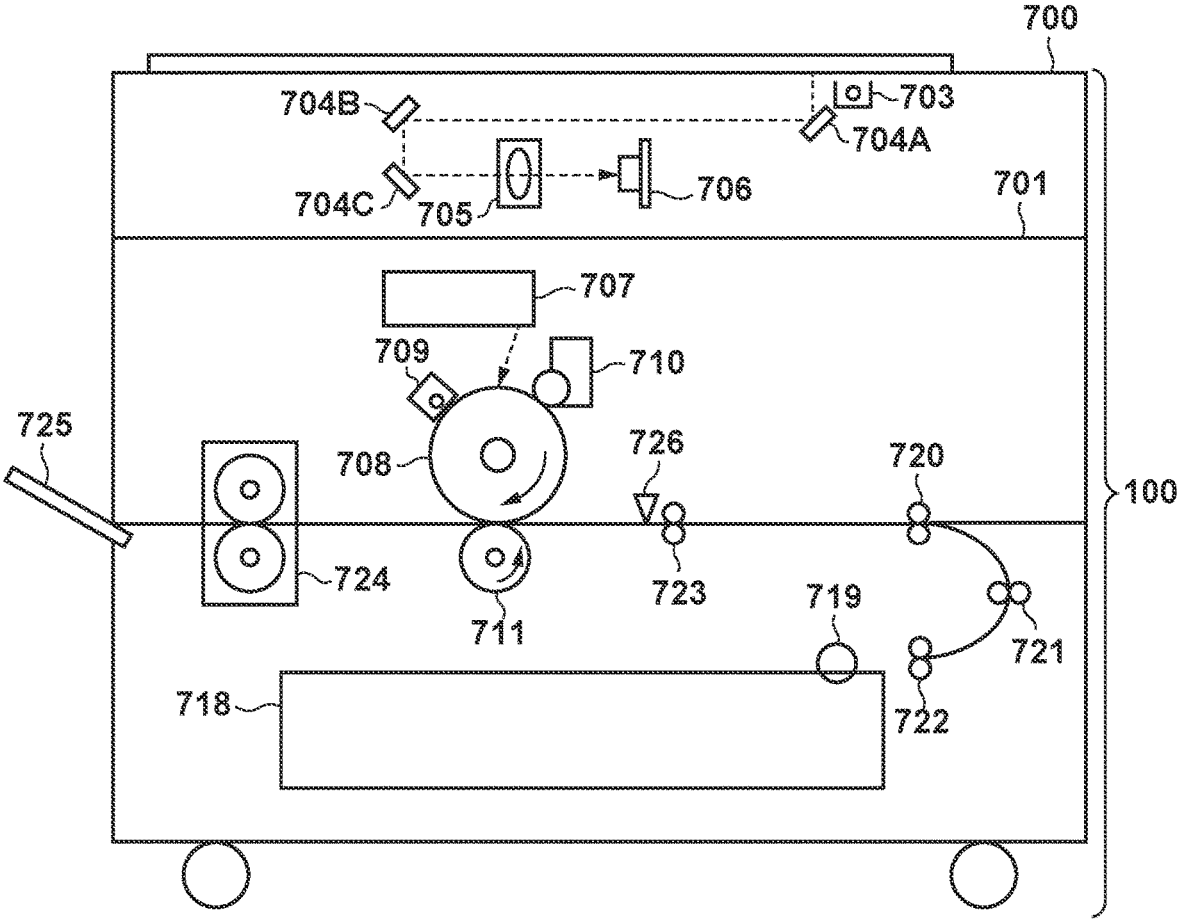
FIG. 1 is a configuration view of an image forming apparatus according to an embodiment.

FIG. 1 is a cross-sectional view that illustrates a configuration of a monochrome electro-photographic method copying machine (hereinafter referred to as an image forming apparatus) 100. Note that the image forming apparatus is not limited to a copying machine, and may be a facsimile apparatus, a printing device, a printer, or the like, for example. In addition, the format of the image forming apparatus may be either a monochrome or color format.

Using FIG. 1, description is given below regarding a configuration and function of the image forming apparatus 100. As illustrated by FIG. 1, the image forming apparatus 100 has an image reading apparatus (hereinafter referred to as a reader) 700, and an image printing apparatus 701.

Light reflected from an original that is irradiated by an illumination lamp 703 at a reading position of the reader 700 is guided to a color sensor 706 by an optical system that comprises reflecting mirrors 704A, 704B, 704C and a lens 705. The reader 700 reads the light incident on the color sensor 706 by each color of blue (hereinafter referred to as B), green (hereinafter, referred to as G), and red (hereinafter referred to as R), and makes conversions to electrical image signals. Furthermore, the reader 700 obtains image data by performing color conversion processing based on the strengths of the B, G, and R image signals, and outputs the image data to an image control unit 1007 (refer to FIG. 3) that will be described later.

A sheet containing tray 718 is provided inside the image printing apparatus 701. A recording medium contained in the sheet containing tray 718 is fed by a paper feed roller 719, and sent out by conveyance rollers 722, 721, and 720 to registration rollers 723 which are in a stopped state. A leading edge of the recording medium conveyed in a conveyance direction by the conveyance rollers 720 abuts a nipping portion of the registration rollers 723 which are in the stopped state. In a state where the leading edge of the recording medium abuts the nipping portion of the registration rollers 723 in the stopped state, the recording medium is bent by the conveyance rollers 720 further conveying the recording medium. As a result, an elastic force works on the recording medium, and the leading edge of the recording medium abuts along the nipping portion of the registration rollers 723. In this way, skew correction of the recording medium is performed. After skew correction of the recording medium is performed, the registration rollers 723 starts conveyance of the recording medium at a timing that is described later. Note that the recording medium is something on which an image is formed by the image forming apparatus, and includes recording mediums such as a sheet, a resin sheet, a cloth, an OHP sheet, and a label, for example.

The image data obtained by the reader 700 is corrected by the image control unit 1007, and inputted to a laser scanner unit 707 that includes a laser and a polygon mirror. In addition, an outer circumferential surface of a photosensitive drum 708 is charged by a charger unit 709. After the outer circumferential surface of the photosensitive drum 708 is charged, laser light in accordance with the image data inputted to the laser scanner unit 707 is irradiated on the outer circumferential surface of the photosensitive drum 708 from the laser scanner unit 707. As a result, a photosensitive layer (a photosensitive member) that covers the outer circumferential surface of the photosensitive drum 708 is exposed in accordance with the image data, and an electrostatic latent image is formed on the photosensitive member. Note that description is given later regarding a configuration where the electrostatic latent image is formed on the photosensitive layer in accordance with the laser light.

Next, the electrostatic latent image is developed by toner in a developing unit 710, and a toner image is formed on the outer circumferential surface of the photosensitive drum 708. The toner image formed on the photosensitive drum 708 is transferred to the recording medium in accordance with a transfer charger unit 711 provided at a position (a transfer position) facing the photosensitive drum 708. Note that the registration rollers 723 supply the recording medium to the transfer position in accordance with a timing such that the toner image is transferred to a predetermined position of the recording medium.

The recording medium to which the toner image has been transferred as described above is supplied to a fixing unit 724 and is subject to heat-pressing by the fixing unit 724, and the toner image is fixed to the recording medium. The recording medium to which the toner image has been fixed is discharged to a discharge tray 725 which is outside of the device.

In this way, the image is formed on the recording medium by the image forming apparatus 100. The above is a description regarding the configuration and function of the image forming apparatus 100.

Configuration in Which an Electrostatic Latent Image is Formed

Figure 2:
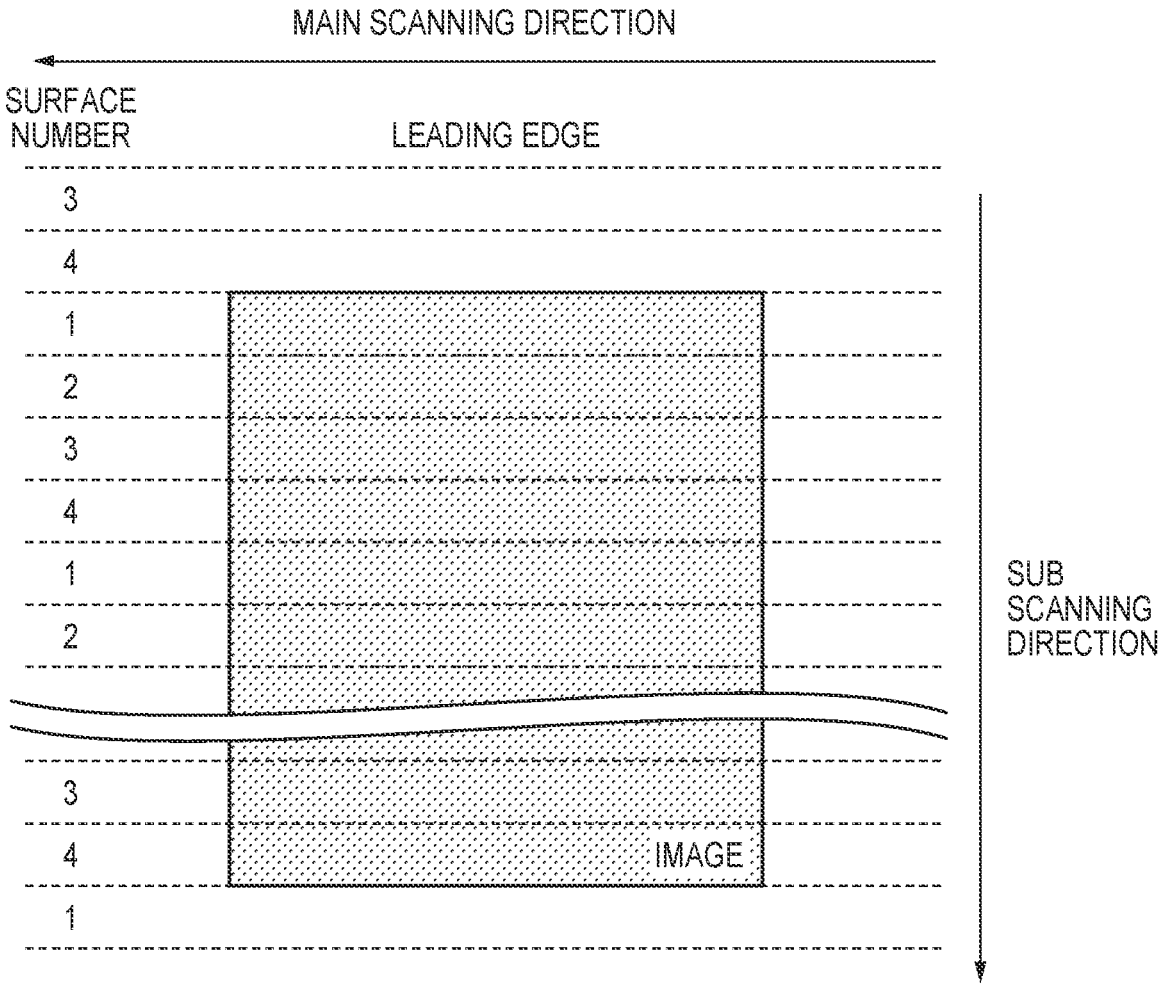
FIG. 2 is a view which illustrates a relationship between a surface number and an image to be formed, according to an embodiment.

FIG. 2 is a view for describing an image for one surface of a recording medium. Surface numbers indicated in FIG. 2 are numbers that indicate respective reflecting surfaces that a polygon mirror 1002 has, and in the present embodiment, the polygon mirror 1002 has four reflecting surfaces.

As illustrated by FIG. 2, by laser light deflected by one reflecting surface out of the plurality of reflecting surfaces that the polygon mirror 1002 has scanning the photosensitive layer in an axial direction (a main scanning direction) of the photosensitive drum 708, an image (an electrostatic latent image) for one scan (one line's worth) is formed on the photosensitive layer. The electrostatic latent image for one surface of the recording medium is formed on the photosensitive layer by scanning of the laser light which is deflected by respective surfaces being repeatedly performed in a rotational direction (a sub scanning direction) of the photosensitive drum 708.

In the following description, data for an image corresponding to an electrostatic latent image for one line's worth is referred to as image data.

Laser Scanner Unit

Figure 3:
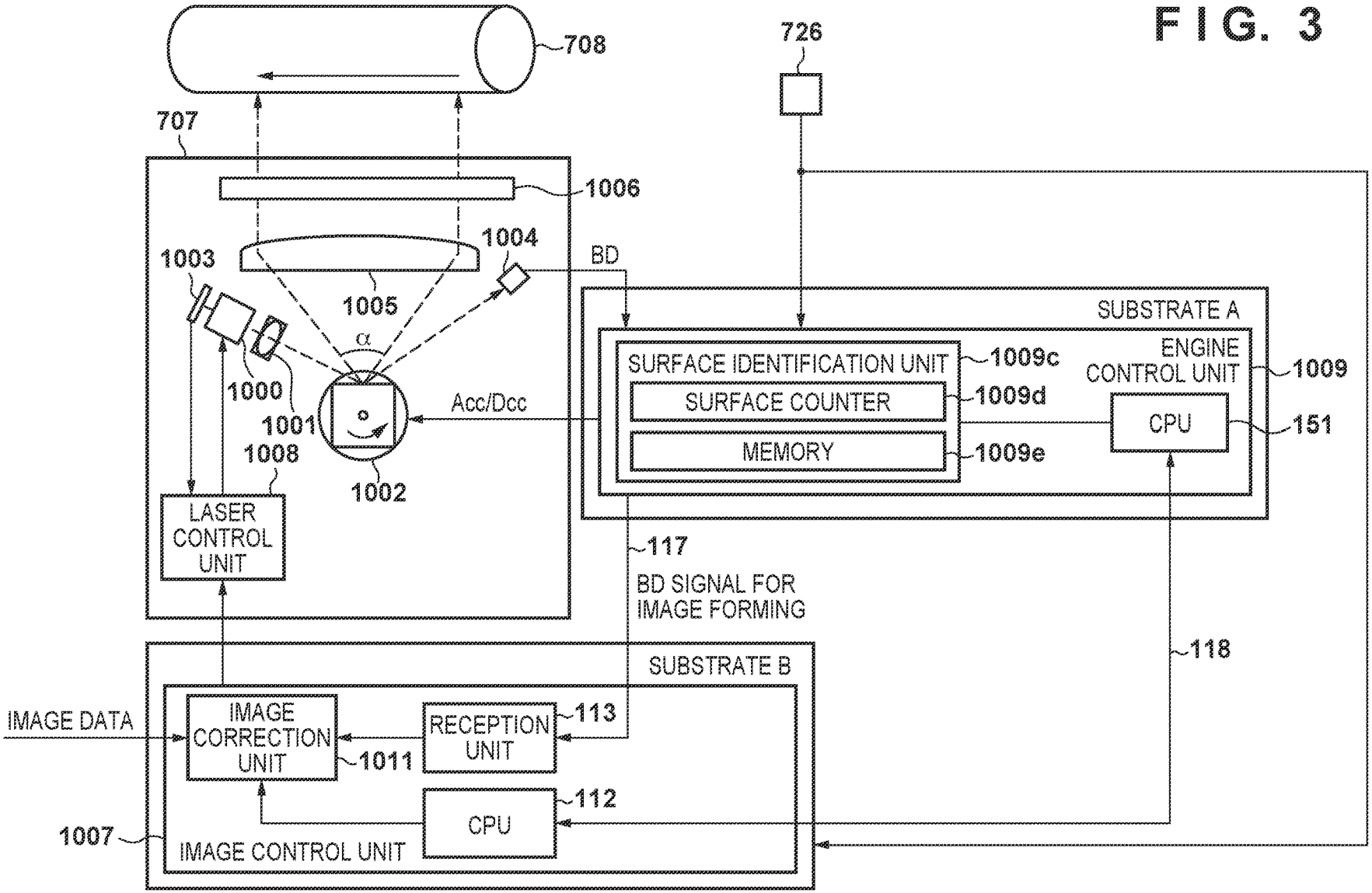
FIG. 3 is a view which illustrates a configuration for forming an electrostatic latent image on a photosensitive drum according to an embodiment.

FIG. 3 is a block diagram that illustrates a configuration of the laser scanner unit 707 in the present embodiment. Description is given below for a configuration of the laser scanner unit 707. Note that, in the present embodiment, a substrate A on which an engine control unit 1009 is provided differs from a substrate B on which the image control unit 1007 is provided, as illustrated by FIG. 3. In addition, the substrate A on which the engine control unit 1009 is provided and the substrate B on which the image control unit 1007 are provided are connected by a cable.

As illustrated by FIG. 3, laser light is emitted from both ends of a laser light source 1000. Laser light emitted from one end of the laser light source 1000 is incident on a photodiode 1003. The photodiode (PD) 1003 converts the incident laser light to an electrical signal, and outputs it to a laser control unit 1008 as a PD signal. The laser control unit 1008, based on the inputted PD signal, performs control (Auto Power Control, referred to as APC below) of an output light amount of the laser light source 1000 so that the output light amount of the laser light source 1000 becomes a predetermined light amount.

Meanwhile, laser light emitted from the other end of the laser light source 1000 is irradiated onto the polygon mirror 1002 as a rotational polygonal mirror, via a collimator lens 1001.

The polygon mirror 1002 is rotationally driven by a polygon mirror motor (not shown). The polygon mirror motor is controlled in accordance with a driving signal (Acc/Dec) outputted from the engine control unit 1009.

The laser light irradiated onto the polygon mirror 1002 which rotates is deflected by the polygon mirror 1002. Scanning of the outer circumferential surface of the photosensitive drum 708 by the laser light deflected by the polygon mirror 1002 is performed from the right toward a leftward direction illustrated in FIG. 3.

The laser light which scans the outer circumferential surface of the photosensitive drum 708 is corrected by an F-θ lens 1005 to scan the outer circumferential surface of the photosensitive drum 708 at a constant speed, and is irradiated onto the outer circumferential surface of the photosensitive drum 708 via a folding mirror 1006.

In addition, the laser light deflected in a predetermined direction by the polygon mirror 1002 is incident on a BD (Beam Detect) sensor 1004 as a light-receiving unit that is provided with a light-receiving element for receiving the laser light. Note that, in the present embodiment, the BD sensor 1004 is arranged at a position so that, in a period of time from when the BD sensor 1004 detects the laser light until the BD sensor 1004 detects the laser light again, the laser light is irradiated onto the outer circumferential surface of the photosensitive drum 708 after the BD sensor 1004 detects the laser light. Specifically, for example, as illustrated by FIG. 3, out of a region that the laser light reflected by the polygon mirror 1002 passes through, the BD sensor 1004 is arranged in a region that is outside of a region represented by an angle α and is upstream with respect to a direction in which the laser light is scanned.

The BD sensor 1004 generates a BD signal as a first signal based on detected laser light, and outputs the BD signal to the engine control unit 1009. Based on the inputted BD signal, the engine control unit 1009 controls the polygon mirror motor so that a rotation period of the polygon mirror 1002 is a predetermined period. When the period of the BD signal becomes a period that corresponds with the predetermined period, the engine control unit 1009 determines that the rotation period of the polygon mirror 1002 has become the predetermined period.

As illustrated by FIG. 1 and FIG. 3, a detection result of a sheet sensor 726, which is for detecting the arrival of the leading edge of a recording medium and is provided at a predetermined position downstream of the registration rollers 723 and upstream of the transfer charger unit 711 in the conveyance direction of the recording medium, is inputted to the engine control unit 1009 and the image control unit 1007.

The engine control unit 1009 outputs a BD signal for image forming 117 to the image control unit 1007 via a signal line, in accordance with the BD sensor 1004 receiving laser light. The BD signal for image forming 117 is synchronized with the BD signal, and corresponds to a second signal that indicates one scanning period for the laser light to scan the photosensitive drum 708.

In accordance with the BD signal for image forming 117 which is inputted to a reception unit 113, the image control unit 1007 outputs corrected image data to the laser control unit 1008. Note that detailed a control configuration of the engine control unit 1009 and the image control unit 1007 is described later.

The laser control unit 1008 causes the laser light source 1000 to turn on based on the inputted image data, to thereby cause laser light for forming an image on the outer circumferential surface of the photosensitive drum 708 to be generated. In this way, the laser control unit 1008 is controlled by the image control unit 1007 as an information processing apparatus. The generated laser light is irradiated onto the outer circumferential surface of the photosensitive drum 708 by the method described above.

Note that a distance L from a position where the sheet sensor 726 detects the recording medium to a transfer position is longer than a distance x in the rotational direction of the photosensitive drum 708 from a position on the outer circumferential surface of the photosensitive drum 708 where laser light is irradiated to the transfer position. Specifically, the distance L results from adding the distance x to a distance in which the recording medium is conveyed in a time period from when the sheet sensor 726 detects the leading edge of the recording medium until the laser light is emitted from the laser light source 1000. Note that in the time period from when the sheet sensor 726 detects the leading edge of the recording medium until the laser light from the laser light source 1000 is emitted, correction of the image data by the image control unit 1007, control of the laser control unit 1008 by the image control unit 1007, or the like are performed.

The above is a description for the configuration of the laser scanner unit 707.

Method for Identifying Surface of Polygon Mirror

The image control unit 1007, in accordance with the period of the BD signal for image forming which is inputted, outputs the corrected image data to the laser control unit 1008 in an order from image data that is most upstream in the sub scanning direction. The laser control unit 1008 controls the laser light source 1000 in response to the inputted image data, to thereby form an image on the outer circumferential surface of the photosensitive drum 708. Note that the number of surfaces of the polygon mirror 1002 is four in the present embodiment, but the number of surfaces of the polygon mirror 1002 is not limited to four.

An image formed on a recording medium is formed in accordance with the laser light deflected by the plurality of reflecting surfaces that the polygon mirror 1002 has. Specifically, as illustrated by FIG. 2, an image corresponding to the image data that is most upstream in the sub scanning direction is formed in accordance with laser light deflected by a first surface of the polygon mirror 1002, for example. In addition, an image corresponding to image data that is second from that most upstream in the sub scanning direction is formed in accordance with laser light deflected by a second surface of the polygon mirror 1002 that differs from the first surface. In this way, an image formed on the recording medium is configured by images formed by laser light reflected by the different reflecting surfaces out of the plurality reflecting surfaces that the polygon mirror 1002 has.

In a case where a polygon mirror having four reflecting surfaces is used as the polygon mirror from deflecting laser light, there is a possibility that an angle formed by two adjacent reflecting surfaces of the polygon mirror 1002 is not exactly 90°. Specifically, in a case where a polygon mirror which has four reflecting surfaces is seen from the rotation axis direction, there is the possibility that an angle formed by two adjacent sides is not exactly 90° (in other words, the shape of the polygon mirror seen from the rotation axis direction is not a square). Note that in a case where a polygon mirror having n (n is a positive integer) reflecting surfaces is used, there is a possibility that the shape of the polygon mirror seen from the rotation axis direction is not a regular n-sided shape.

In a case where a polygon mirror having four reflecting surfaces is used, when the angle formed by two adjacent reflecting surfaces of the polygon mirror is not exactly 90°, the position and size of an image formed by laser light differs for each reflecting surface. As a result, a deformation occurs in an image formed on the outer circumferential surface of the photosensitive drum 708, and a deformation also occurs in the image formed on the recording medium.

Accordingly, in the present embodiment, correction (for example, correction of a write start position) in accordance with a correction amount (correction data) respectively corresponding to the plurality of reflecting surfaces that the polygon mirror 1002 has is performed with respect to the image data. In such a case, a configuration for identifying a surface by which the laser light is deflected is necessary. Description is given below for an example of a method for identifying a surface by which the laser light is deflected. In the present embodiment, a surface identification unit 1009*c*, which is provided in the engine control unit 1009, identifies the surface that deflects (reflects) the laser light, from among the plurality of reflecting surfaces that the polygon mirror 1002 is provided with.

Figure 4A:
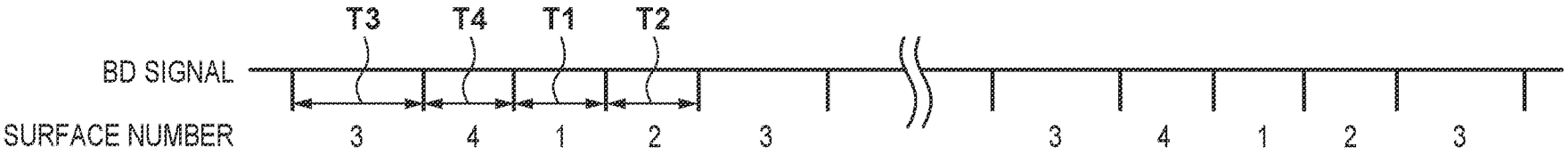
FIGS. 4A and 4B are views for describing surface identification processing according to an embodiment.

FIG. 4A is a view that illustrates an example of a relationship between a BD signal generated by laser light scanning the light-receiving surface of the BD sensor 1004, and a surface by which the laser light is deflected (a surface number). As illustrated by FIG. 4A, the amount of time from falling of the pulse of a BD signal to a next falling of the pulse of the BD signal after rising the BD signal (scanning period) differs for each surface of the polygon mirror 1002. Note that the scanning period corresponds to an amount of time from when laser light scans the light-receiving surface of the BD sensor 1004 until, after the laser light scans the light-receiving surface, the laser light first scans a light-receiving surface again.

In FIG. 4A, a period corresponding to a surface number 1 is indicated by T1, a period corresponding to a surface number 2 is indicated by T2, a period corresponding to a surface number 3 is indicated by T3, and a period corresponding to a surface number 4 is indicated by T4. Note that each period is stored in a memory 1009*e* provided in the surface identification unit 1009*c*.

Figure 4B:
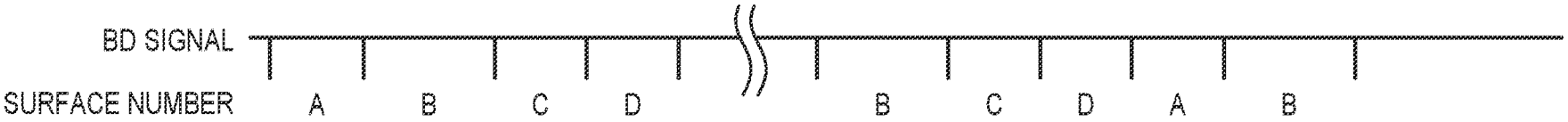

The surface identification unit 1009*c* identifies a surface (a surface number) by which laser light is deflected by the following method. Specifically, the surface identification unit 1009*c* sets surface numbers A through D with respect to four consecutive scanning periods of the BD signal, as illustrated by FIG. 4B. The surface identification unit 1009*c* measures the scanning period for each of the surface numbers A through D a plurality of times (for example, 32 times), and calculates an average value of the measured period for each of the surface numbers A through D. Based on the calculated periods and the periods T1 through T4 stored in the memory 1009*e*, the engine control unit 1009 determines how the surface numbers A through D correspond to the surface numbers 1 through 4.

As described above, based on the inputted BD signal, the surface identification unit 1009*c* identifies the number of the surface (the reflecting surface used for scanning of the photosensitive drum 708 from out of the plurality of reflecting surfaces that the polygon mirror 1002 has) by which the laser light is deflected. In this way, the surface identification unit 1009*c* functions as an identification unit.

Engine Control Unit

Figure 5:
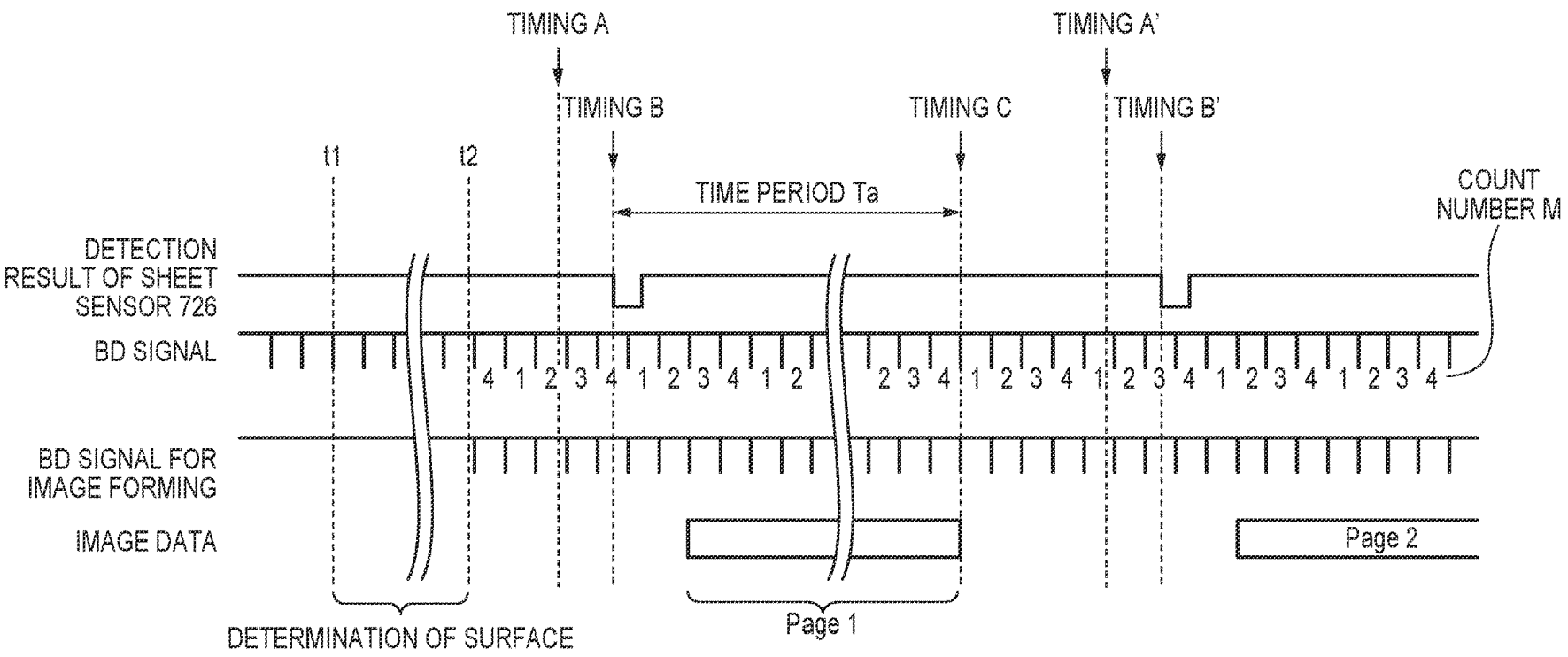
FIG. 5 is a view which illustrates a relationship between a BD signal and another signal, according to an embodiment.

Next, FIG. 3 and FIG. 5 are used to give a description regarding control performed by the engine control unit 1009 in the present embodiment. As illustrated by FIG. 3, the surface identification unit 1009*c* has a surface counter 1009*d* for storing surface information that indicates the reflecting surface that deflects the laser light that scans the light-receiving surface of the BD sensor 1004, from out of the plurality of reflecting surfaces.

FIG. 5 is a time chart that illustrates a relationship between various signals and a count number M of the surface counter 1009*d*. Note that the count number M of the surface counter 1009*d* corresponds to surface information. When the rotation period of the polygon mirror 1002 becomes a predetermined period (a time t1), the engine control unit 1009 (the surface identification unit 1009*c*) identifies the surface number (determines the surface) by the method described above, based on the inputted BD signal. The engine control unit 1009 starts a count by the surface counter 1009*d* from a time t2 when identification (estimation) of the surface number by the surface identification unit 1009*c* ends. Specifically, when identification of the surface number ends, the engine control unit 1009 sets the surface number corresponds to the BD signal first inputted after identification of the surface number ends as an initial value of the count number M of the surface counter 1009*d*. After setting the initial value of the count number M, the engine control unit 1009 updates the count number M each time a falling edge of the inputted BD signal is detected, for example. Note that, when the polygon mirror 1002 has n (n is a positive integer) reflecting surfaces, M is a positive integer that satisfies $1 \leq M \leq n$.

Subsequently, the CPU 151 controls the engine control unit 1009 to execute printing (form an image on a recording medium) (a timing A). As a result, the engine control unit 1009 starts driving of the registration rollers 723. As a result, the leading edge of a first recording medium is detected by the sheet sensor 726 (a timing B). Note that the timing A is decided by the CPU 151 in accordance with the processing time of a print job inputted to the image forming apparatus 100. In other words, the timing A is not limited to the timings illustrated on FIG. 5. In addition, in the present embodiment, a detection result illustrated in FIG. 5 becoming a low level corresponds to the sheet sensor 726 detecting the leading edge of a recording medium.

Communication Between Engine Control Unit and Image Control Unit

Next, description is given regarding communication in accordance with a communication line (a signal line) 118 between the image control unit 1007 and the engine control unit 1009. A CPU 112 of the image control unit 1007 and the CPU 151 of the engine control unit 1009 are connected by the communication line 118. By the communication line 118, the image control unit 1007 transmits a command signal for notifying to the engine control unit 1009 a command or settings for various apparatuses inside the image forming apparatus 100, for example. By the communication line 118, the image control unit 1007 transmits a status signal for notifying to the engine control unit 1009 status information for various apparatuses inside the image forming apparatus 100, for example. Furthermore, in the present embodiment, by the communication line 118, the engine control unit 1009 notifies the image control unit 1007 of information for indicating a reflecting surface use for scanning (hereinafter referred to as surface information). An image correction unit 1011 stores a plurality of pieces of correction data respectively corresponding to the plurality of reflecting surfaces, in association with the surface information. The image correction unit 1011 corrects the image signal based on the surface information notified from the engine control unit 1009 via the communication line 118 to generate an image signal, and outputs the image signal to the laser control unit 1008 in accordance with a timing (a BD timing) when the BD signal for image forming 117 is inputted to the reception unit 113.

Communication by the communication line 118 can be realized by serial communication such as UART (Universal Asynchronous Receiver/Transmitter), for example. Besides UART, it is also possible to use serial communication that synchronizes with a clock signal, or parallel communication that has a plurality of data buses.

Figure 6:
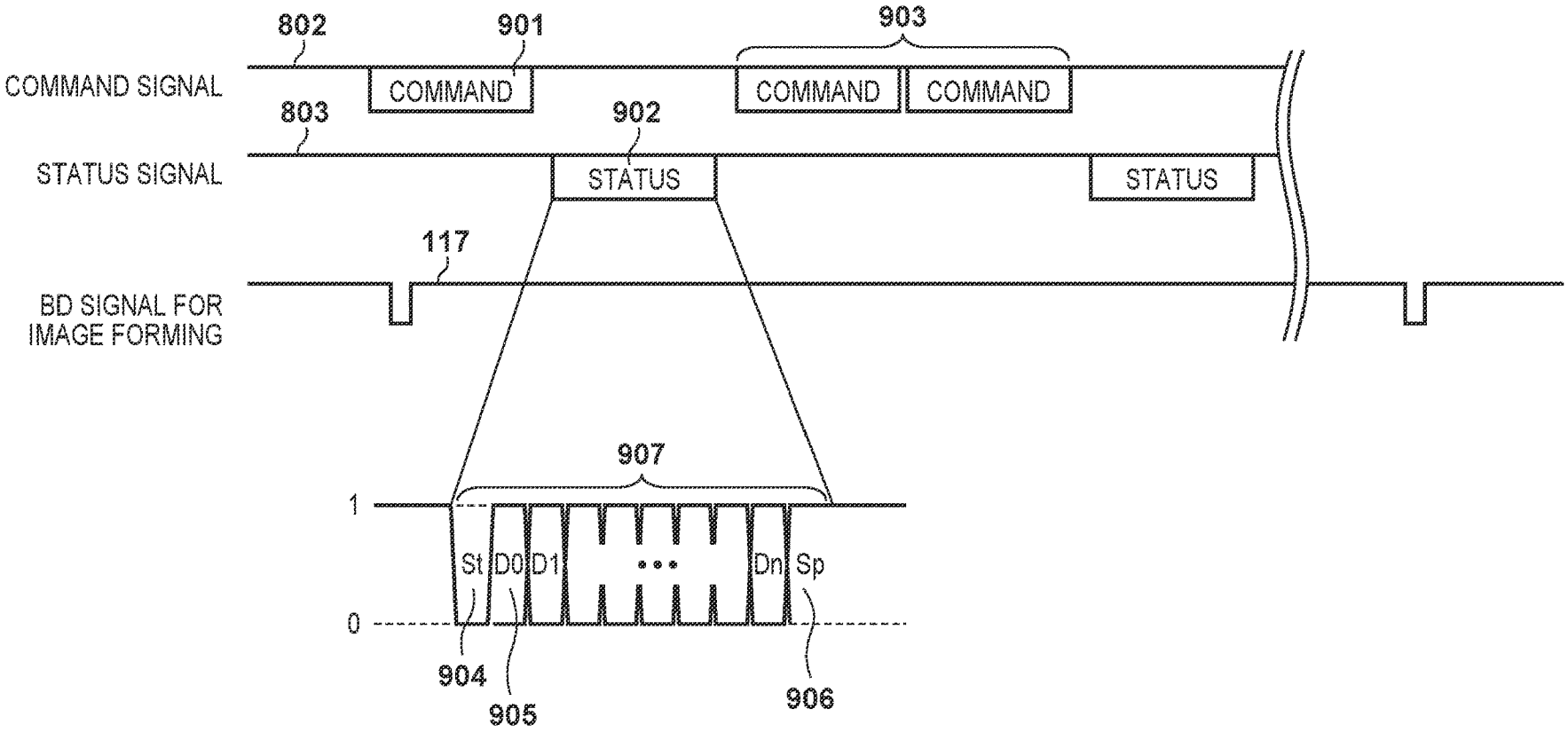
FIG. 6 is a view for describing each signal according to an embodiment.

FIG. 6 illustrates communication timings of a command signal 802 and a status signal 803 that are transmitted and received by the communication line 118, and data formats thereof. A command 901 illustrates a command from the image control unit 1007 to the engine control unit 1009. The content of a command in accordance with the command 901 is a command for setting a sheet type (for example, a size or thickness), a command for starting printing, command for setting print speed, or the like. The image control unit 1007 can consecutively transmit two commands, as illustrated by commands 903. In such a case, for example, it is possible to have the first command indicate command details and have the subsequent command be arguments for the command details indicated by the first command.

In contrast, the status signal 803 is a signal that is notified from the engine control unit 1009 to the image control unit 1007. The engine control unit 1009 transmits a status 902 to the image control unit 1007 as a response to the command signal 802, for example. The status 902 indicates a status (state) of the engine control unit 1009 as a response to a command by the image control unit 1007. In addition, there are cases where the status 902 is an ACK (Acknowledgement) indicating that the command 901 was correctly received. Furthermore, it is possible for the status 902 to be subject to a push notification from the engine control unit 1009 even in a case where there is no command from the image control unit 1007. For example, when the sheet containing tray 718 is opened by a user, the engine control unit 1009 can make a push notification of the status 902 which indicates something to that effect to the image control unit 1007.

A reference code 907 of FIG. 6 indicates the format of the status 902 or the commands 901 and 903. A start bit St 904 indicates whether a command or a status follows. Data bits D0 through Dn 905 indicate details of the command or status. A stop bit Sp 906 indicates the end of transmission of the command or status. Note that transmission and reception of a command or status is not related to operation of the polygon mirror 1002, and is performed asynchronously with BD timings. Note that a BD timing is a timing when the BD sensor 1004 receives light.

Typically, the number of data bits is on the order of 5 bits to 9 bits. In addition, a data rate for serial communication is typically several kbps to several Mbps. In contrast, an interval for BD timings is on the order of several hundred μs. For example, when the data rate for serial communication is 500 kbps and the data bit length for a command and a status is 8 bits, transmission of one command or status completes in approximately 16 μs. Accordingly, when the interval between BD timings is 500 μs, it is possible to transmit approximately 30 commands or statuses between the BD timings.

Figure 7:
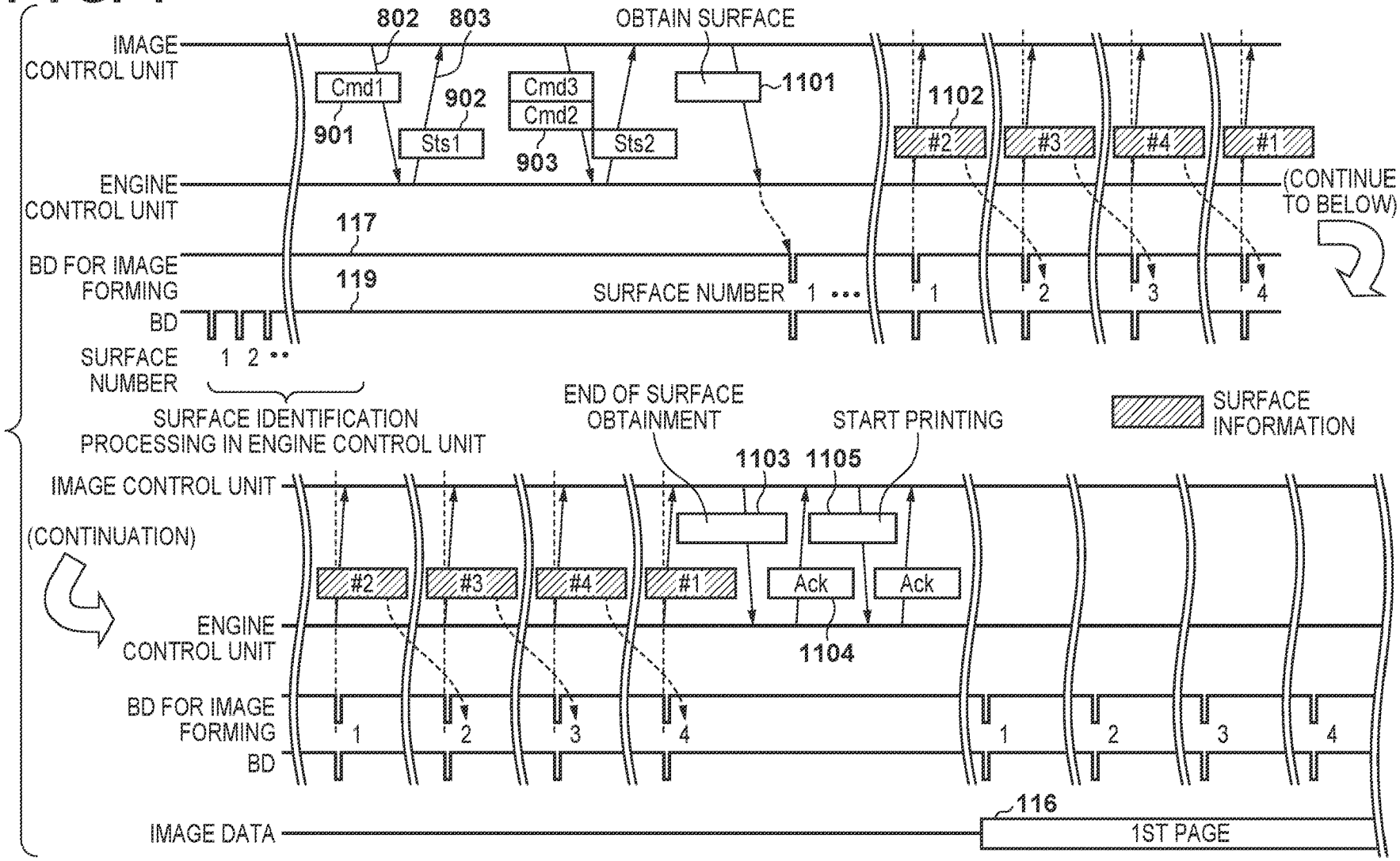
FIG. 7 is a timing chart of surface information notification processing according to an embodiment.

FIG. 7 is for describing notification of surface information via the communication line 118. The abscissa of FIG. 7 indicates time. In addition, in FIG. 7, a command from the image control unit 1007 to the engine control unit 1009 is indicated by an arrow that points from up to down, and a status from the engine control unit 1009 to the image control unit 1007 is indicated by an arrow that points from down to up. Prior to an image forming process, the engine control unit 1009 starts rotationally driving the polygon mirror 1002, and performs surface identification processing based on the BD signal 119 outputted from the scanner unit 707.

In accordance with the commands 901 and 903 or the like, the image control unit 1007 instructs the engine control unit 1009 to make necessary settings prior to image formation. The engine control unit 1009 transmits a response to each command, such as the status 902, to the image control unit 1007. When transmission of necessary commands completes, the image control unit 1007 transmits a surface obtainment command 1101 for requesting surface information to the engine control unit 1009. Upon receiving the surface obtainment command 1101, the engine control unit 1009, in synchronization with the BD timings, and, transmits to the image control unit 1007 surface information 1102 indicating the reflecting surface of the polygon mirror 1002 that reflects light as a status from the next BD timing. Upon receiving the surface information 1102 over a number of rotations of the polygon mirror 1002 (may be for one rotation), the image control unit 1007 transmits a surface obtainment end command 1103 to the engine control unit 1009. After transmitting the surface obtainment command 1101, the image control unit 1007 does not transmit other commands until the image control unit 1007 transmits the surface obtainment end command 1103. Similarly, the engine control unit 1009, in a duration after receiving the surface obtainment command 1101 and until the surface obtainment end command 1103 is received, only transmits the surface information 1102 and does not transmit another status. Upon receiving the surface obtainment end command 1103, the engine control unit 1009 transmits an ACK 1104 to the image control unit 1007. Subsequently, the image control unit 1007 transmits a printing start command 1105 to the engine control unit 1009, and the engine control unit 1009 transmits an ACK as a response thereto. Subsequently, the image control unit 1007 transmits, based on the BD timings, image signals generated by making corrections in accordance with the surface information. Note that, in FIG. 7, it is assumed that the engine control unit 1009 autonomously performs surface identification processing in advance. However, it is possible to have a configuration in which the image control unit 1007 transmits a command to the engine control unit 1009 instructing it to execute surface identification processing, and the engine control unit 1009 thereby executes surface identification processing.

Therefore, by virtue of the present embodiment, the engine control unit 1009, in synchronization with BD timings, notifies surface information to the image control unit 1007. Thereby, the image control unit 1007 can identify a relationship between BD timings and the reflecting surfaces of the polygon mirror. In addition, transmission and reception of other commands or statuses is stopped during transmission of surface information by the engine control unit 1009. Accordingly, it is possible to use the communication line 118, which is for transmitting and receiving commands or statuses, to notify BD timings between the engine control unit 1009 and the image control unit 1007.

Image Control Unit

Figure 8:
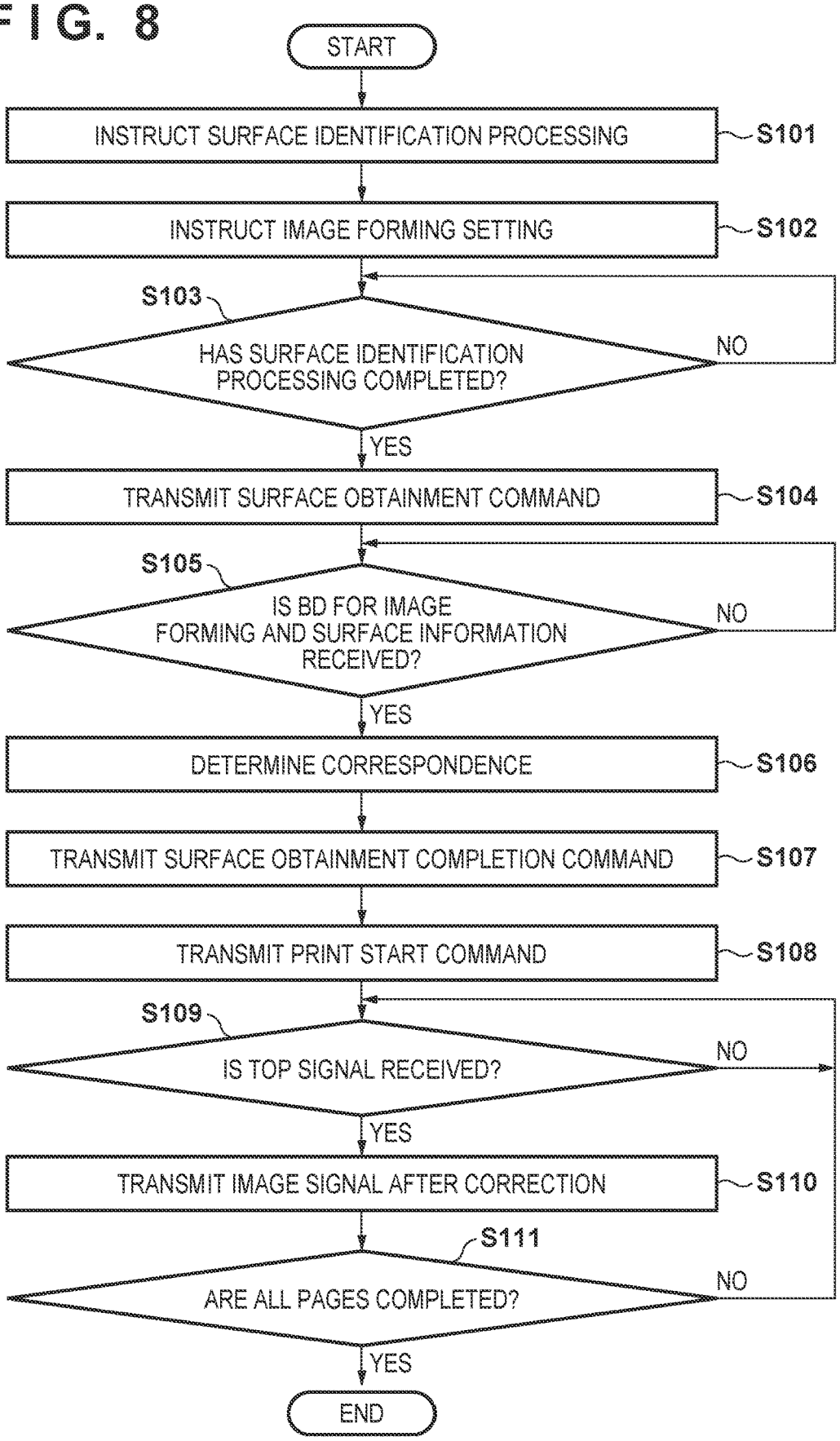
FIG. 8 is a flowchart of an image forming process according to an embodiment.

FIG. 8 is a flowchart of an image forming process executed by the image control unit 1007.

In step S101, the image control unit 1007 instructs the engine control unit 1009 to execute surface identification processing. As a result, the engine control unit executes surface identification processing.

Next, in step S102, the image control unit 1007 transmits various setting commands necessary for image formation to the engine control unit 1009. The engine control unit 1009 sets various apparatuses of the image forming apparatus 100 based on the various setting commands. Subsequently, in step S103, when the completion of the surface identification processing is transmitted from the engine control unit 1009 to the image control unit 1007 by a status signal, in step S104, the image control unit 1007 transmits the surface obtainment command 1101 to the engine control unit 1009.

In step S105, the image control unit 1007 waits until a necessary number of pieces of surface information are received, and, in step S106, determines an association relationship between BD timings and surface numbers. Subsequently, in step S107, the image control unit 1007 transmits the surface obtainment end command 1103 to the engine control unit 1009. As a result, the engine control unit 1009 stops transmission of surface information by status signals.

In step S108, the image control unit 1007 transmits the printing start command 1105 to the engine control unit 1009. As a results, the engine control unit 1009 starts conveyance of a sheet by the registration rollers 723.

Subsequently, in step S109, upon receiving a signal indicating that the sheet sensor 726 has detected the leading edge of a sheet (a TOP signal), the image control unit 1007, in step S110, synchronizes with the BD signal for image forming 117 to transmit an image signal for which a correction in accordance with the reflecting surface is performed.

Subsequently, in step S111 the image control unit 1007 determines whether image formation has completed with respect to all sheets that are targets of printing, and repeats processing from step S109 when this has not completed. Meanwhile, when image formation to all sheets that are targets of printing has completed, the image control unit 1007 ends the processing of FIG. 8.

Figure 9:
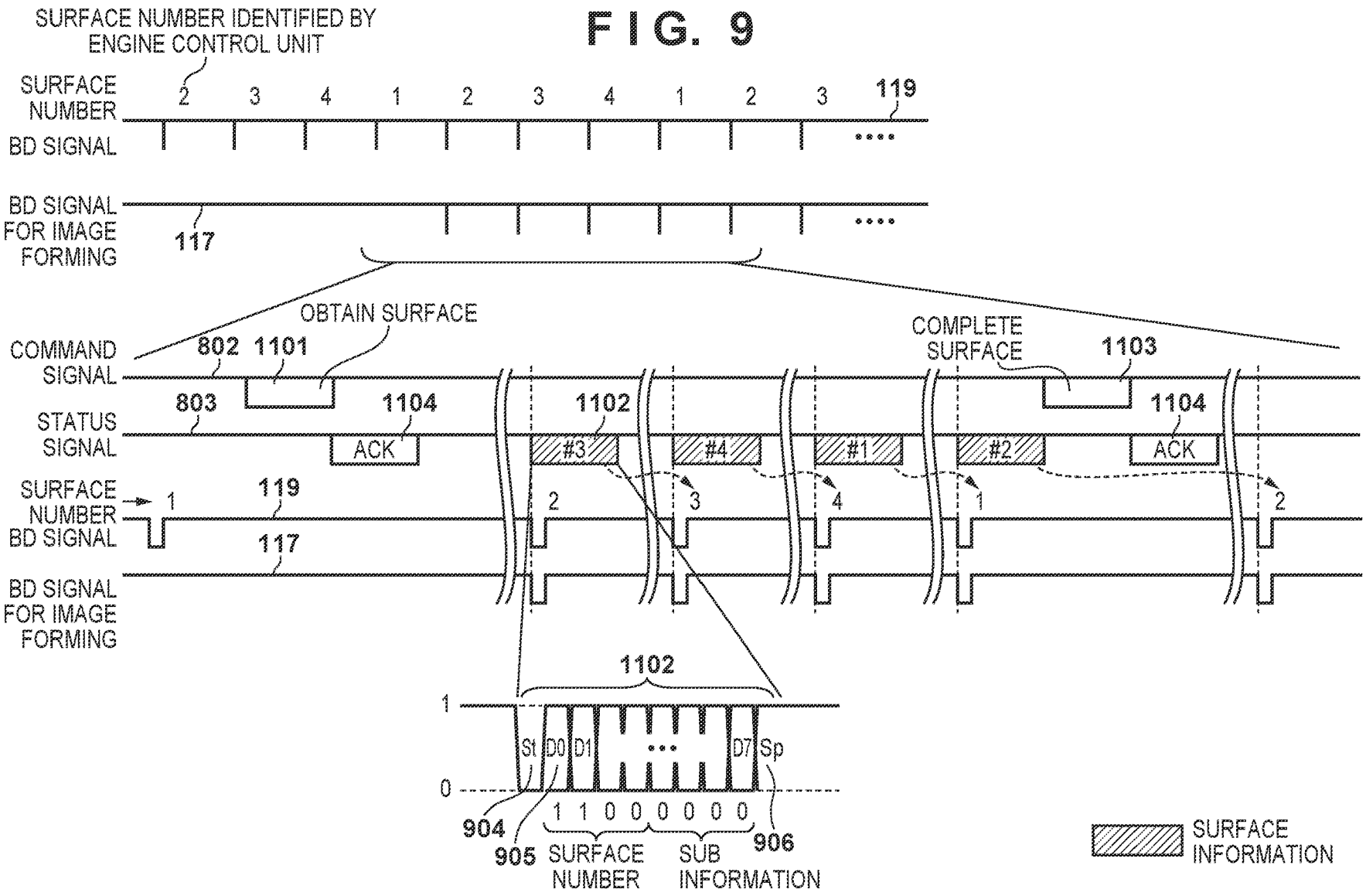
FIG. 9 is a view for describing a surface number which is indicated by surface information according to an embodiment.

Finally, using the timing chart of FIG. 9, description is given regarding timings at which the image control unit 1007 receives surface information, and a communication format thereof. The top part of FIG. 9 indicates the BD signal 119 received by the engine control unit 1009, and the BD signal for image forming 117 that the engine control unit 1009 transmits to the image control unit 1007. In addition, the surface numbers are identified by the engine control unit 1009. The bottom part of FIG. 9 illustrates details of the top part of the figure. When the image control unit 1007 transmits the surface obtainment command 1101 to the engine control unit 1009, the engine control unit 1009 returns the ACK 1104 as a response. Subsequently, the engine control unit 1009, in synchronization with a BD timing (a falling edge) indicated by the BD signal for image forming 117, transmits the surface information 1102 to the image control unit 1007 by the status signal 803. In the example of FIG. 9, the surface information 1102 indicates the surface number of the reflecting surface used for scanning from the next the BD timing. Specifically, the engine control unit 1009 transmits the surface information 1102 indicating the surface number 3 in synchronization with a BD timing for a time when the BD sensor 1004 receives light reflected by the reflecting surface for the surface number 2. This is to make it easier to achieve timing after the image control unit 1007 has recognized a surface number. In this way, the engine control unit 1009 transmits the surface number that corresponds to the next BD timing as the surface information 1102. Upon receiving a predetermined number of pieces of surface information, the image control unit 1007 transmits the surface obtainment end command 1103.

Note that if a relationship between a surface number indicated by the surface information 1102 which is transmitted at a certain BD timing and a BD timing that indicates a time when this surface number is used for scanning is known beforehand by the engine control unit 1009 and the image control unit 1007, the present invention is not limited to a relationship as described above. For example, at a certain BD timing, the engine control unit 1009 can transmit, by the surface information 1102, the surface number of a reflecting surface used for scanning from the BD timing. Similarly, at a certain BD timing, the engine control unit 1009 can transmit, by the surface information 1102, the surface number of a reflecting surface used for scanning from a BD timing that is two or three BD timings after the certain BD timing. To make a more generic description, in synchronization with a BD timing for a timing when a first reflecting surface is reflecting light, the engine control unit 1009 transmits surface information indicating a second reflecting surface which has a predetermined positional relationship with the first reflecting surface. Note that the positional relationship between the second reflecting surface and the first reflecting surface is set in the engine control unit 1009 and the image control unit 1007 in advance. In this way, the surface information is status data that indicates a rotation state of the polygon mirror 1002. In addition, in the flowchart of FIG. 8, printing starts after the image control unit 1007 receives a predetermined number of pieces of the surface information 1102, but configuration can be taken such that printing starts in accordance with the reception of surface information.

In addition, the format of the surface information 1102 is illustrated in FIG. 9. According to FIG. 9, the surface information 1102 represents a surface number in binary by the lower 4 bits (D0 to D3) of 8-bit data. In addition, the upper 4 bits are used as sub information. For the sub information, for example, a code indicating that the lower 4 bits are a surface number is set.

Note that, in the present embodiment, description was given for a monochrome electro-photographic method copying machine, but the configuration of the present embodiment may also be applied to a color electro-photographic method copying machine.

The laser light source 1000, the polygon mirror 1002, the photosensitive drum 708, the BD sensor 1004, and the engine control unit 1009 in the present embodiment are included in an image forming unit.

In addition, in the present embodiment, the image control unit 1007 outputs corrected image data to the laser control unit 1008, but there is no limitation to this. For example, configuration may be such that the image control unit 1007 outputs corrected image data to the engine control unit 1009, and the engine control unit 1009 outputs this image data to the laser control unit 1008. In other words, it is sufficient if there is a configuration in which the image control unit 1007 outputs corrected image data to an image forming unit.

In addition, in the present embodiment, as described by FIG. 4A, FIG. 4B and FIG. 5, the surface number is identified based on the period of the BD signal, but a method for identifying the surface number is not limited to this. For example, the surface number may be identified based on a phase difference between a signal indicating the rotation period of a motor that rotationally drives the polygon mirror (for example, an FG signal, a signal of an encoder, or the like), and a BD signal.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-244420, filed on Dec. 20, 2017, which is hereby incorporated by reference herein in its entirety.

What is claimed is:

1. An information processing apparatus connected with an image forming apparatus including an image forming unit, the image forming unit comprising:

a first reception unit configured to receive image data;

a light source configured to output light based on the image data received by the first reception unit;

a rotational polygonal mirror having a plurality of reflecting surfaces, and configured to, by rotating, deflect the light output from the light source to scan a photosensitive member by using the plurality of reflecting surfaces;

a light-receiving unit configured to receive the light deflected by the rotational polygonal mirror;

an identification unit configured to identify a reflecting surface used for scanning of the photosensitive member, out of the plurality of reflecting surfaces;

a first output unit configured to use a first signal line to output a predetermined signal in accordance with the light-receiving unit receiving the light;

a second output unit configured to use a second signal line different to the first signal line to output surface information indicating the reflecting surface identified by the identification unit, the surface information being output in response to the first output unit outputting the predetermined signal; and the information processing apparatus comprising:

a second reception unit configured to receive the predetermined signal output via the first signal line from the first output unit;

a third reception unit configured to receive the surface information output via the second signal line from the second output unit;

a storage unit configured to store, in association with the surface information, a plurality of pieces of correction data respectively corresponding to a different one of the plurality of reflecting surfaces;

a correction unit configured to correct the image data corresponding to a reflecting surface onto which the light for scanning the photosensitive member is to be deflected, based on correction data, which is stored in the storage unit, corresponding to the surface information received by the third reception unit; and a third output unit configured to, in response to the second reception unit receiving the predetermined signal output by the first output unit, output the corrected image data to the image forming unit, wherein the information processing apparatus further comprises a control unit configured to transmit and receive data, which is different to the surface information, with the image forming unit via the second signal line.

2. The information processing apparatus according to claim 1, wherein the control unit is further configured to not transmit and receive data different to the surface information via the second signal line in a period of time in which the surface information is being inputted to the third reception unit via the second signal line.

3. The information processing apparatus according to claim 1, wherein the surface information is output from the second output unit via the second signal line in synchronization with the predetermined signal which the first output unit outputs using the first signal line.

4. The information processing apparatus according to claim 1, wherein the control unit is further configured to use the second signal line to output a signal for requesting the image forming unit for the surface information, and the surface information is output from the second output unit in response to the signal for requesting the surface information.

5. The information processing apparatus according to claim 4, wherein the control unit is further configured to use the second signal line to output to the image forming unit a signal for stopping the surface information, and output of the surface information is stopped in accordance with the signal for stopping the surface information.

6. The information processing apparatus according to claim 1, wherein the third output unit is further configured to start output to the image forming unit of the corrected image data for one surface of a recording medium in response to a second signal being output from the image forming unit.

7. The information processing apparatus according to claim 6, wherein the image forming unit has a development unit configured to develop a latent image formed on the photosensitive member by the light scanning the photosensitive member; and a transfer unit configured to transfer an image developed by the development unit to a recording medium, wherein the third output unit is further configured to, in response to outputting, as the second signal, a signal indicating a detection of a leading edge of the recording medium from a detection unit that is for detecting the leading edge of the recording medium and is provided at a predetermined position upstream from a position where transfer of the image to the recording medium by the transfer unit is performed in a conveyance direction in which the recording medium is conveyed, start output of the corrected image data for one surface of the recording medium to the image forming unit.

8. The information processing apparatus according to claim 1, wherein a substrate on which the second reception unit is provided differs to a substrate on which the first output unit is provided, and the substrate on which the second reception unit is provided is connected by a cable to the substrate on which the first output unit is provided.

9. The information processing apparatus according to claim 1, wherein the correction unit is further configured to use first correction data corresponding to a reflecting surface on which the light output from the light source based on first image data is deflected to correct the first image data, and use second correction data corresponding to a reflecting surface on which the light output from the light source based on second image data different to the first image data is deflected to correct the second image data.

10. An image forming apparatus comprising a generation unit configured to generate image data; and an image forming unit configured to form an image on a sheet based on the image data output from the generation unit, wherein the image forming unit comprises:

a first reception unit configured to receive image data;

a light source configured to output light based on the image data received by the first reception unit;

a rotational polygonal mirror having a plurality of reflecting surfaces, and configured to, by rotating, deflect the light output from the light source to scan a photosensitive member by using the plurality of reflecting surfaces;

a light-receiving unit configured to receive the light deflected by the rotational polygonal mirror;

an identification unit configured to identify a reflecting surface used for scanning of the photosensitive member, out of the plurality of reflecting surfaces;

a first output unit configured to use a first signal line to output a predetermined signal in accordance with the light-receiving unit receiving the light; and a second output unit configured to use a second signal line different to the first signal line to output surface information indicating the reflecting surface identified by the identification unit, the surface information being output in response to the first output unit outputting the predetermined signal; and the generation unit comprises:

a second reception unit configured to receive the predetermined signal output via the first signal line from the first output unit;

a third reception unit configured to receive the surface information output via the second signal line from the second output unit;

a storage unit configured to store, in association with the surface information, a plurality of pieces of correction data respectively corresponding to a different one of the plurality of reflecting surfaces;

a correction unit configured to correct the image data corresponding to a reflecting surface onto which the light for scanning the photosensitive member is to be deflected, based on correction data, which is stored in the storage unit, corresponding to the surface information received by the third reception unit;

a third output unit configured to, in response to the second reception unit receiving the predetermined signal output by the first output unit, output the corrected image data to the image forming unit, wherein the generation unit further comprises a control unit configured to transmit and receive data, which is different to the surface information, with the image forming unit via the second signal line.

11. The image forming apparatus according to claim 10, wherein the control unit is further configured to not transmit and receive data different to the surface information via the second signal line in a period of time in which the surface information is being inputted to the third reception unit via the second signal line.

12. The image forming apparatus according to claim 10, wherein the surface information is output from the second output unit via the second signal line in synchronization with the predetermined signal which the first output unit outputs using the first signal line.

13. The image forming apparatus according to claim 10, wherein the control unit is further configured to use the second signal line to output a signal for requesting the image forming unit for the surface information, and the surface information is output from the second output unit in response to the signal for requesting the surface information.

14. The image forming apparatus according to claim 13, wherein the control unit is further configured to use the second signal line to output to the image forming unit a signal for stopping the surface information, and output of the surface information is stopped in accordance with the signal for stopping the surface information.

15. The image forming apparatus according to claim 10, wherein the third output unit is further configured to start output to the image forming unit of the corrected image data for one surface of a recording medium in response to a second signal being output from the image forming unit.

16. The image forming apparatus according to claim 15, wherein the image forming unit comprises:

a development unit configured to develop a latent image formed on the photosensitive member by the light scanning the photosensitive member; and a transfer unit configured to transfer an image developed by the development unit to a recording medium, and the third output unit is further configured to, in response to outputting, as the second signal, a signal indicating a detection of a leading edge of the recording medium from a detection unit that is for detecting the leading edge of the recording medium and is provided at a predetermined position upstream from a position where transfer of the image to the recording medium by the transfer unit is performed in a conveyance direction in which the recording medium is conveyed, start output of the corrected image data for one surface of the recording medium to the image forming unit.

17. The image forming apparatus according to claim 10, wherein a substrate on which the second reception unit is provided differs to a substrate on which the first output unit is provided, and the substrate on which the second reception unit is provided is connected by a cable to the substrate on which the first output unit is provided.

18. The image forming apparatus according to claim 10, wherein the correction unit is further configured to use first correction data corresponding to a reflecting surface on which the light output from the light source based on first image data is deflected to correct the first image data, and use second correction data corresponding to a reflecting surface on which the light output from the light source based on second image data different to the first image data is deflected to correct the second image data.

* * * * *